US008081129B1

(12) United States Patent
Santori et al.

(10) Patent No.: US 8,081,129 B1
(45) Date of Patent: Dec. 20, 2011

(54) MEMRISTIVE ANTENNA

(75) Inventors: Charles M. Santori, Palo Alto, CA (US); David A. Fattal, Mountain View, CA (US); Marco Fiorentino, Mountain View, CA (US); Raymond G. Beausoleil, Redmond, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 329 days.

(21) Appl. No.: 12/415,715

(22) Filed: Mar. 31, 2009

(51) Int. Cl.
*H01Q 9/00* (2006.01)

(52) U.S. Cl. ..... 343/749; 343/745; 343/748

(58) Field of Classification Search ..... 343/745, 343/748, 749; 257/4; 463/22, 25; 324/10
See application file for complete search history.

(56) References Cited

U.S. PATENT DOCUMENTS

| | | | | |
|---|---|---|---|---|
| 7,898,844 | B2 * | 3/2011 | Wang et al. | 365/158 |
| 2009/0131151 | A1 * | 5/2009 | Harris et al. | 463/22 |
| 2010/0093429 | A1 * | 4/2010 | Mattice et al. | 463/25 |
| 2010/0155686 | A1 * | 6/2010 | Bratkovski et al. | 257/4 |

OTHER PUBLICATIONS

Strukov, Dmitri B., et al., "The Missing Memristor Found", *Nature "Letters"* vol. 453. Nature06932, (May 1, 2008), 80-83.

Seshagiri, K. V., et al., "Antenna Design for UHF RFID Tags: A Review and a Practical Application", *IEEE Transactions on Antennas and Propagation*, vol. 52. No. 12, (Dec. 2005),3870-3907.

Tang, Liang et al., "Nanometre-Scale Germaniom Photodector Enhanced by a Near-Infared Dipole Antenna", *Nature Photonics*. vol. 2. www.nature.com/naturephotonics., (Mar. 16, 2008),226-229.

Alu, Andrea "Tuning the Scattering Response of Optical Nanoantennas Withe Nanocircuit Loads", *Nature Photonics*, vol. 2. www.nature.com/naturephotonics., (Apr. 20, 2008),307-310.

Ly-Gagnon, Dany-Sebastien et al., "Characteristic Impedance Model for Plasmonic Metal Slot Waveguides", *ISSS Journal of Selected Topics in Quantum Electronics*, vol. 14, No. 6, (Nov./Dec. 2008),1473-1478.

Yan, H. et al., "An Integration Scheme for RF Power Harvesting", http://www.stw.nl/NR/rdonlyres/29370104-25E9-435D-ABF6-514067953266/0/yan.pdf, (Sep. 26, 2005), 64-66.

* cited by examiner

*Primary Examiner* — Hoang V Nguyen

(57) ABSTRACT

An energy responsive device. The device includes a memristor and at least one antenna. The memristor is coupled to the at least one antenna.

18 Claims, 7 Drawing Sheets

MEMRISTIVE ANTENNA

FIELD

Embodiments of the present technology relates generally to the field of electrical circuits.

BACKGROUND

Traditionally, resistors, capacitors and inductors have been used as the three basic elements used to make an electrical circuit. However, memristors, also referred to as memory resistors, have properties of a distinctly different basic element. A memristor has a property of memristance that allows for a variety of time-varying functions based on a net charge. Moreover, memristance cannot be duplicated by any combination of the other three elements. For example, if charge flows in one direction through a circuit, the resistance of that component of the circuit will increase, and if the charge flows in the opposite direction in the circuit, the resistance will decrease. If the flow of the charge is stopped by turning off the applied voltage, the component will "remember" the last resistance that it had, and when the flow starts again the resistance in the circuit will be what it was when it was last active.

Figure 1A:
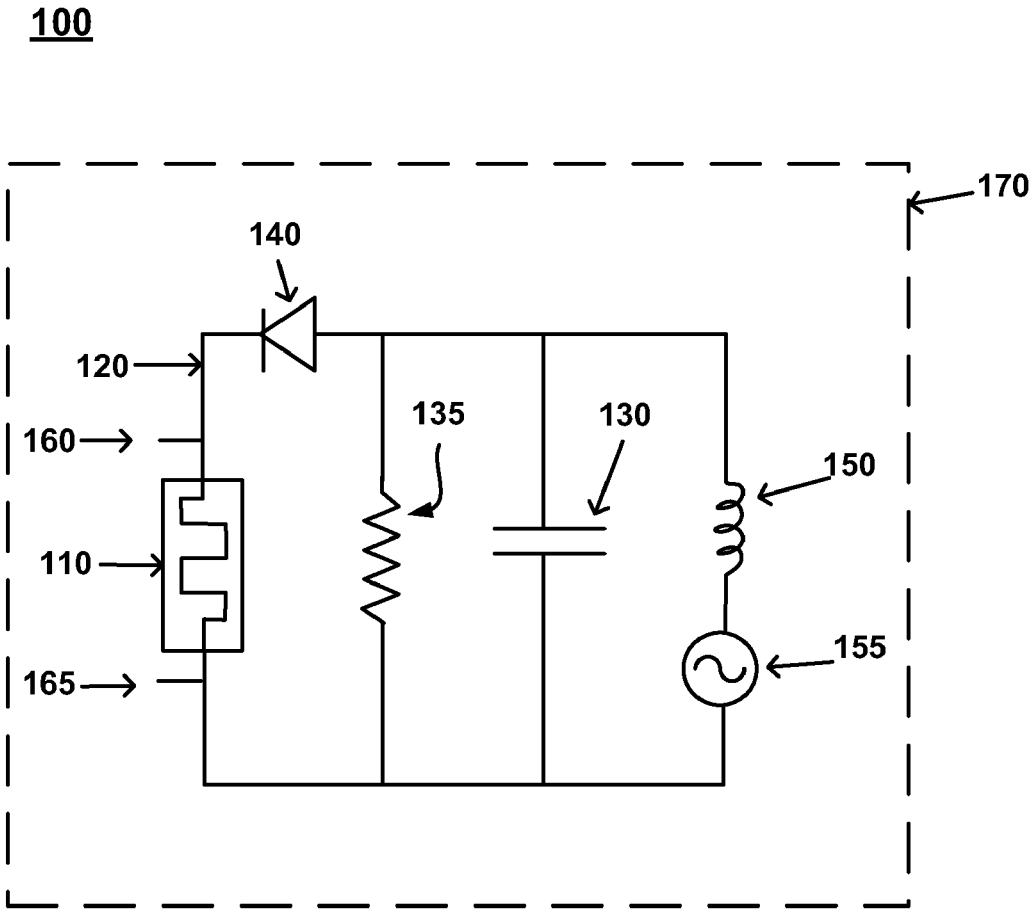
FIG. 1A illustrates an example of a memristive antenna, in accordance with an embodiment of the present invention.

The drawings referred to in this description should be understood as not being drawn to scale except if specifically noted.

DESCRIPTION OF EMBODIMENTS

Reference will now be made in detail to embodiments of the present technology, examples of which are illustrated in the accompanying drawings. While the technology will be described in conjunction with various embodiment(s), it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following description of embodiments, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the present embodiments.

A memristor shares many of the properties of a resistor and also shares the same unit of measurement (ohms). In an ordinary resistor, there is a linear relationship between current and voltage. However, in contrast to an ordinary resistor, in which the resistance is permanently fixed, memristance may be programmed or switched to different resistance states based on the history of the voltage applied to the memristance material. It should be appreciated that a memristor is similar to a resistor with hysteresis.

There are many ways to create a memristor. It should be appreciated that a memristor can be created by a titanium oxide structure, where change in resistance occurs because of migration of oxygen vacancies in the dioxide layer. For example, the titanium oxide structure includes two titanium dioxide film layers, one of which has a depletion of oxygen atoms. The oxygen vacancies in the depleted layer act as charge carriers due to the depleted layer having a much lower resistance than the non-depleted layer. When an electric field is applied, the oxygen vacancies drift, changing the boundary between the high-resistance and low-resistance layers. Thus, the resistance of the film as a whole is dependent on how much charge has been passed through it in a particular direction, which is reversible by changing the direction of current. It should also be appreciated that memristance is often only detected in a nanoscale device. Therefore, memristance becomes very important for understanding the electronic characteristics of any device in the nanometer scale.

It should be appreciated that memristors typically provide easy configurability to circuits. For instance, memristors may be used to selectively open and close connections within circuits because they can be switched between high and low resistances (as well as any resistance in between). Moreover, in contrast to many conventional electrical elements, the switching may be repeatedly reconfigured or reprogrammed.

A memristor coupled to an antenna can allow for the change of memristance in the memristor in response to transmitted energy. In general, an antenna is designed to transmit or receive electromagnetic waves. For example, antennas convert electromagnetic waves into electrical currents and vice versa. Typically, an antenna generates a radiating electromagnetic field in response to an applied alternating voltage and the associated alternating electric current or the antenna responds to an electromagnetic field so that the field will induce an alternating current and associated alternating voltage. It is the induced alternating current by an applied electromagnetic field to the antenna that is able to change the memristance in the memristor.

Accordingly, the type of antenna is a function of the type(s) of electromagnetic waves that are transmitted and/or received. For example, an radio frequency identification (RFID) tag would have an antenna that is capable of transmitting and/or receiving radio frequency (RF) electromagnetic waves. Other devices that are sensitive to infrared and/or optical frequencies would utilize an antenna that is able to transmit and/or receive infrared and/or optical frequencies, such as a nanoantenna. An optical antenna is one example of a nanoantenna that is able to operate within the visible and infrared portion of the electromagnetic spectrum.

A memristor coupled to an antenna can allow for a programmable response to transmitted energy. An embodiment in accordance with the present invention provides a device 100 for responding to a transmitted energy frequency, as illustrated in FIG. 1A. Energy responsive device 100 includes at least one circuit which includes at least a memristor 110 and an antenna. It should be appreciated that the circuit schematic to describe the circuit of device 100 is to help describe the electrical function of the physical implementation of the circuit. It should also be appreciated that the physical implementation and geometry of the circuit may not be represented by the physical representation of the circuit schematic. For example, the physical implementation and geometry of the circuit and its components can be any physical implementation and geometry that is able to form the electrical function of circuit schematic.

In one embodiment, the device 100 includes a wire loop 120 and a rectifier 140 coupled to the circuit. The rectifier 140 can be a diode. Without rectification, an oscillating magnetic field will induce an alternating current (AC) 155 through memristor 110. If it is an ideal memristor, the total integrated charge will be approximately zero (depending on initial conditions), and there will be no net change in memristance. If there is rectification, currents induced by oscillating magnetic fields can flow in one direction only, and a total charge can be accumulated in the circuit. For a non-ideal memristor with asymmetric response to positive and negative voltages, a rectifier may not be required.

The device 100 also includes a capacitor 130, resistor 135 and an inductor 150. In another embodiment, the device includes capacitance and/or inductance properties. The circuit, as shown, has some inductance properties because of the wire loop 120. It should be appreciated that the wire loop 120 is an antenna.

In various embodiments, the circuit acts as an antenna without any physical appearances that resemble a loop. Furthermore, the inductance and capacitance may not necessarily be produced by discrete components, but rather may be produced by geometrical arrangements of metal wires, pads, backplanes and the like, designed to act as an antenna. It should be appreciated the circuit can be described (to a good approximation) by an equivalent circuit that includes an antenna element (which can be represented as any combination of inductors, capacitors and resistors), a voltage source representing the voltage induced by an external electromagnetic field driving the antenna, a memristor, and optionally, a diode.

The device 100 generates a resonant frequency in response to a transmitted energy frequency. For example, if a radio frequency (RF) electromagnetic field is applied to the device 100, then there is a magnetic flux through the wire loop 120 that oscillates in sign with respect to time. This induces an AC voltage 155 through the wire loop 120 that causes a current to flow through the memristor 110. The current then induces a change in the memristance of the memristor over time. The current also generates a re-radiated (backscattered) RF field that can be detected externally. In one embodiment, the response of the wire loop 120 to the applied RF field is changed due to the change in memristance of the memristor. The electrical properties, such as voltage, current and/or resistance can be measured by an electrical measuring instrument attached to leads 160 and 165 across the memristor 110. In addition, changes in the memristance can be detected externally through RF fields re-radiated by the device in response to the applied RF field. It should be appreciated that the device 100 is responsive to frequencies such as but not limited to radio, microwave, infrared and optical. It should be appreciated that device 100 includes a material 170 that the circuit is coupled to. The material 170 can be any material that is compatible to being coupled to the circuit.

In one embodiment, the circuit as depicted in FIG. 1A, when a voltage is induced by an applied RF, the circuit has a sharp resonance at $$f_0 = \frac{1}{2\pi\sqrt{LC}}, \tag{1}$$

if $RC \gg 1/f_0$ and if (1) the drive amplitude is small (below diode threshold), or (2) if the drive power is large but memristance $R_m$ satisfies $R_m C \gg 1/f_0$, where L is the inductance, C is the capacitance and R is the resistance.

In another embodiment, when the memristor 110 is switched to its conducting state, the frequency response of the circuit is altered, especially for drive powers strong enough to overcome the diode threshold.

Figure 1B:
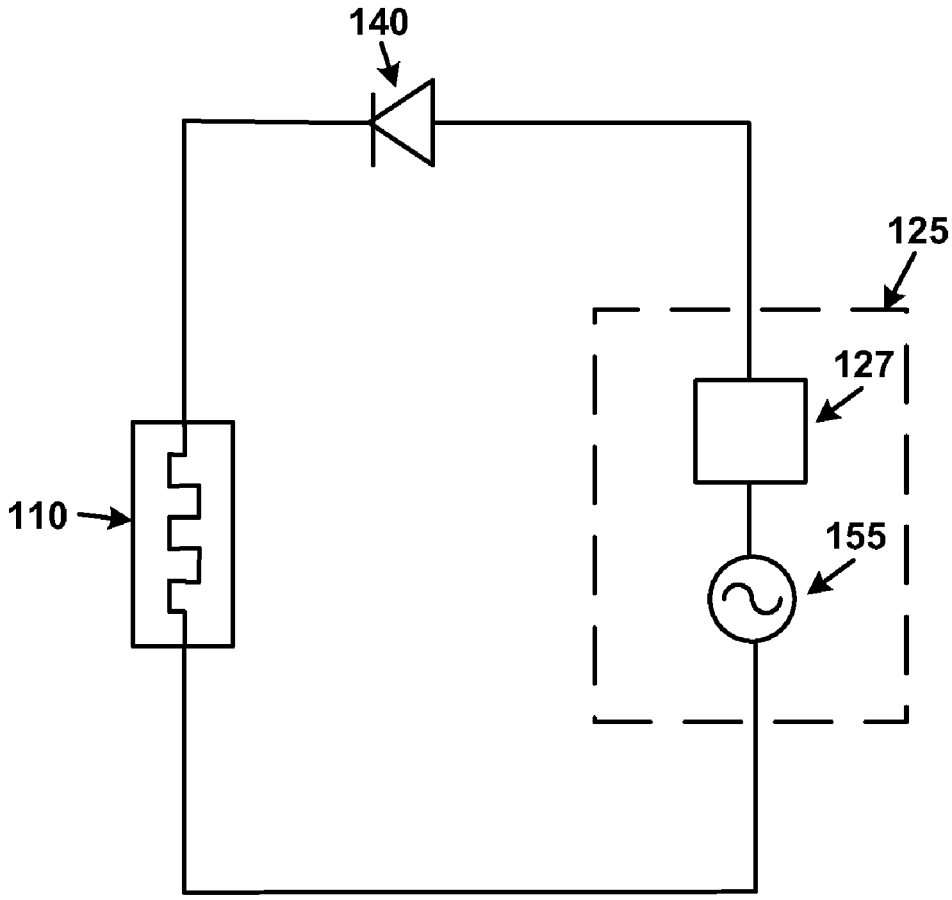
FIG. 1B illustrates an example of a memristive antenna, in accordance with an embodiment of the present invention.

An embodiment in accordance with the present invention provides a circuit for responding to a transmitted energy frequency, as illustrated in FIG. 1B. In one embodiment, the circuit includes a memristor 110, a rectifier 140 and an antenna 125. In one embodiment, the antenna 125 is a voltage source 155 with an amplitude proportional to the applied electromagnetic field amplitude (the induced voltage may also depend on frequency), and a linear element with a frequency-dependent, complex impedance 127.

By controlling the memristance of the memristor by the applied frequency, such as an applied RF field, the device 100 is programmable and erasable. In one embodiment, the device 100 is externally programmable. For example, the device is externally programmable by using an electromagnetic field to change the memristance of the memristor 110. In other words, the electromagnetic field induces a switching voltage in the circuit.

Figure 1C:
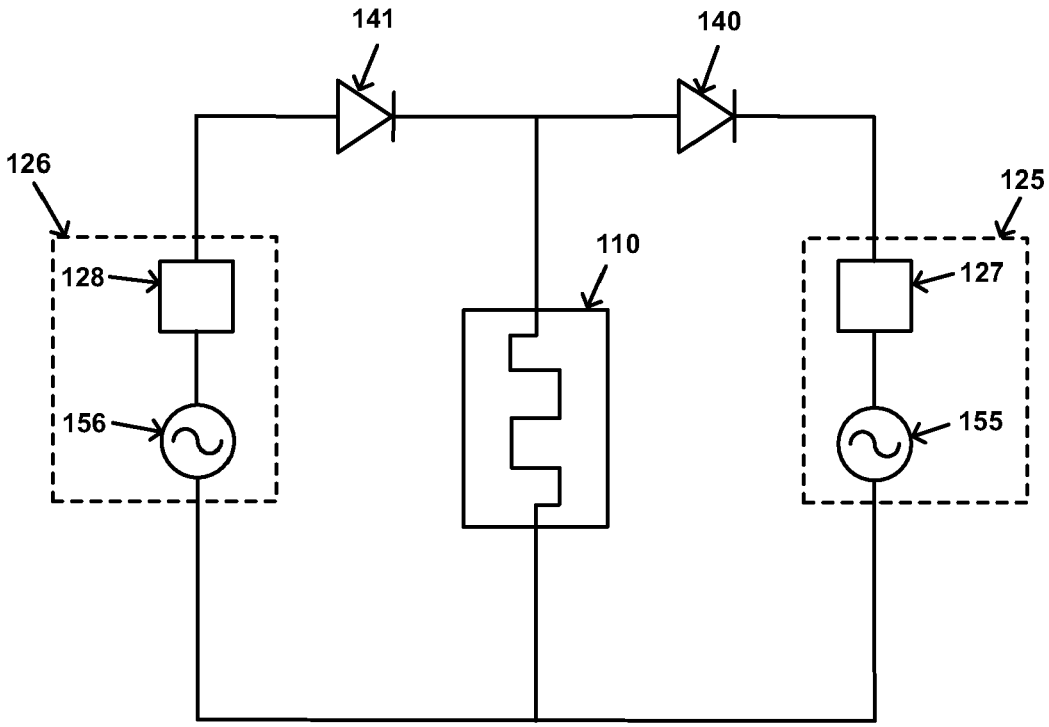
FIG. 1C illustrates an example of a memristive antenna, in accordance with an embodiment of the present invention.

An embodiment in accordance with the present invention provides a circuit for responding to a transmitted energy frequency, as illustrated in FIG. 1C. The programmable circuit includes a memristor 110, rectifiers 140 and 141, and antennas 125 and 126. The antennas 125 and 126 include impedances 127 and 128, respectively, and applied AC voltages 155 and 156, respectively. It should be appreciated that antennas 125 and 126 have different resonant frequencies. Accordingly, by using at least two different antennas with at least two different resonant frequencies, the resonant frequencies can be selectively driven to change the memristor to either its conductive or non-conductive state.

Figure 1D:
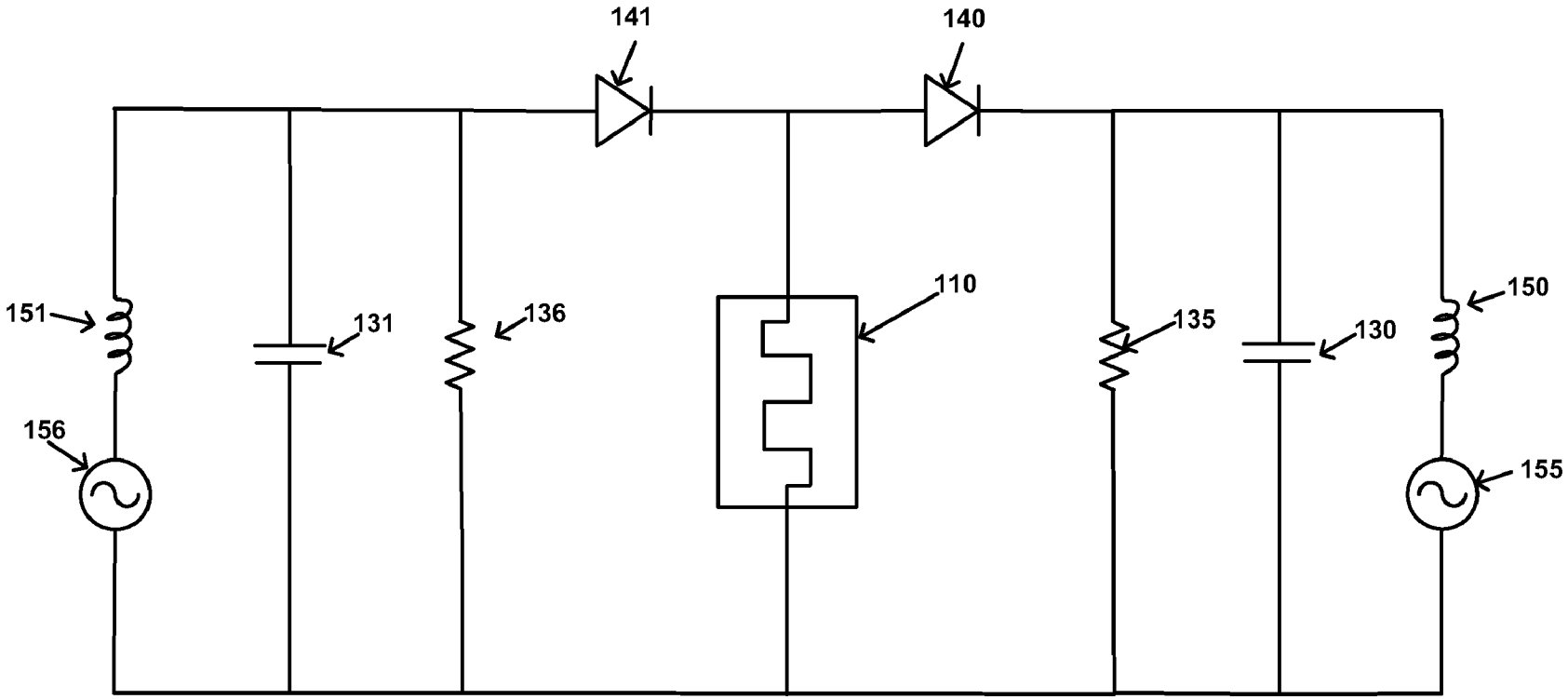
FIG. 1D illustrates an example of a memristive antenna, in accordance with an embodiment of the present invention.

An embodiment in accordance with the present invention provides a circuit for responding to a transmitted energy frequency, as illustrated in FIG. 1D. The programmable and erasable circuit includes a memristor 110, rectifiers 140 and 141, resistors 135 and 136, capacitors 130 and 131, inductors 150 and 151 and applied AC voltages 155 and 156. It should be appreciated that a first LRC (inductor (L), resistance (R) and capacitance (C)) circuit which includes memristor 110, rectifier 140, resistor 135, capacitor 130, inductor 150 and AC voltage 155 is driven at a frequency $f_0$. It should be appreciated that a second LRC circuit which includes memristor 110, rectifier 141, resistor 136, capacitor 131, inductor 156 and AC voltage 156 is driven at a frequency $f_0'$. In one embodiment, the frequency $f_0$ generates a direct current (DC) through the memristor 110 that switches the memristor to its non-conducting state. When this occurs, the frequency response of both circuits is altered, especially for large drive voltages. In another embodiment, the second LRC circuit generates a DC through the memristor 110 in the opposite direction. Accordingly, the memristor will eventually switch back to its conducting state.

In another embodiment, the device is internally programmable. For example, an electrical interface may be applied to the circuit via leads 160 and 165 (as depicted in FIG. 1A) that causes the memristance of a memristor to be changed. Likewise, the device 100 is also externally erasable by an electrical interface.

Figure 2:
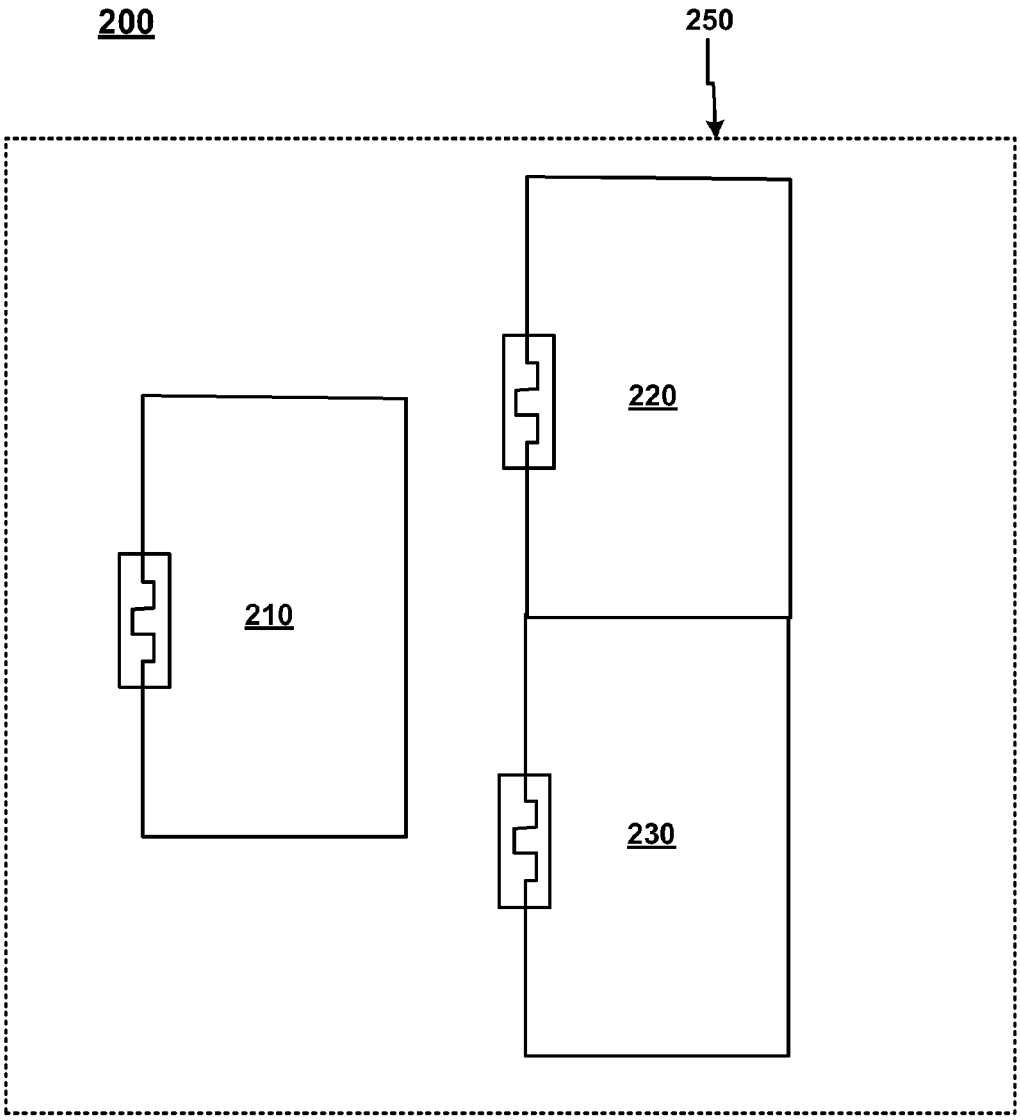
FIG. 2 illustrates an example of an array of memristive antennas, in accordance with an embodiment of the present invention.

An embodiment in accordance with the present invention provides an array of devices 200 for responding to a transmitted energy frequency, as illustrated in FIG. 2. The array of devices 200 includes energy responsive devices 210, 220 and 230. It should be appreciated that devices 210, 220 and 230 at least include a wire loop and a memristor. It should be appreciated that devices 220 and 230 are electrically coupled to one another and that device 210 is an independent circuit. In one embodiment, the resonant frequencies of the devices are the same. In another embodiment, the resonant frequency of each device is different. For example, the array 200 can be multichannel, such that a plurality of different resonant frequencies are independently generated and sensed. It should be appreciated that the array of devices 200 can have a plurality of different configurations such as but not limited to none of the devices in the array being coupled together, all of the devices being connected in a circuit, a combination of devices coupled together and a combination of devices not coupled together.

It should be appreciated that the array of devices 200 can include other electrical components such as but not limited to diodes, inductors and capacitors. It should be appreciated that the array of devices includes a material 250 that the circuit(s) is coupled to. The material can be any material that is compatible to being coupled to the circuit(s).

It should be appreciated that arbitrary circuit configuration (s) incorporates inductance, capacitance and a memristor such that the circuit(s) have a resonant frequency. It should be appreciated that an applied time-varying magnetic flux will induce a voltage across a memristor(s) and a resonant antenna is connected to a memristor.

The array of devices 200 is programmable by controlling at least one memristance of a memristor by an applied frequency, such as an applied RF field. In one embodiment, the array of devices 200 is externally programmable. For example, the device is externally programmable by using an electromagnetic field to change at least one memristance of a memristor. In other words, an electromagnetic field induces a switching voltage across the memristor. It should be appreciated that the array of devices can be programmed into an arbitrary array of loops or other circuits of various areas, perimeters and configurations.

In another embodiment, the array of devices is internally programmable. For example, an electrical interface may be applied to at least one of the devices in the array of devices, via leads near at least one memristor. The electrical interface causes a memristance of a memristor to be changed. In another embodiment, the array of devices 200 is erasable. If at least one memristor in the array of devices is programmable by an applied electromagnetic field, such as but not limited to an applied RF field, then a circuit can be designed such that the array of devices 200 can also be erased by an applied electromagnetic field, such as but not limited to an applied RF field. Likewise, the plurality of devices are also externally erasable by an electrical interface.

Figure 3:
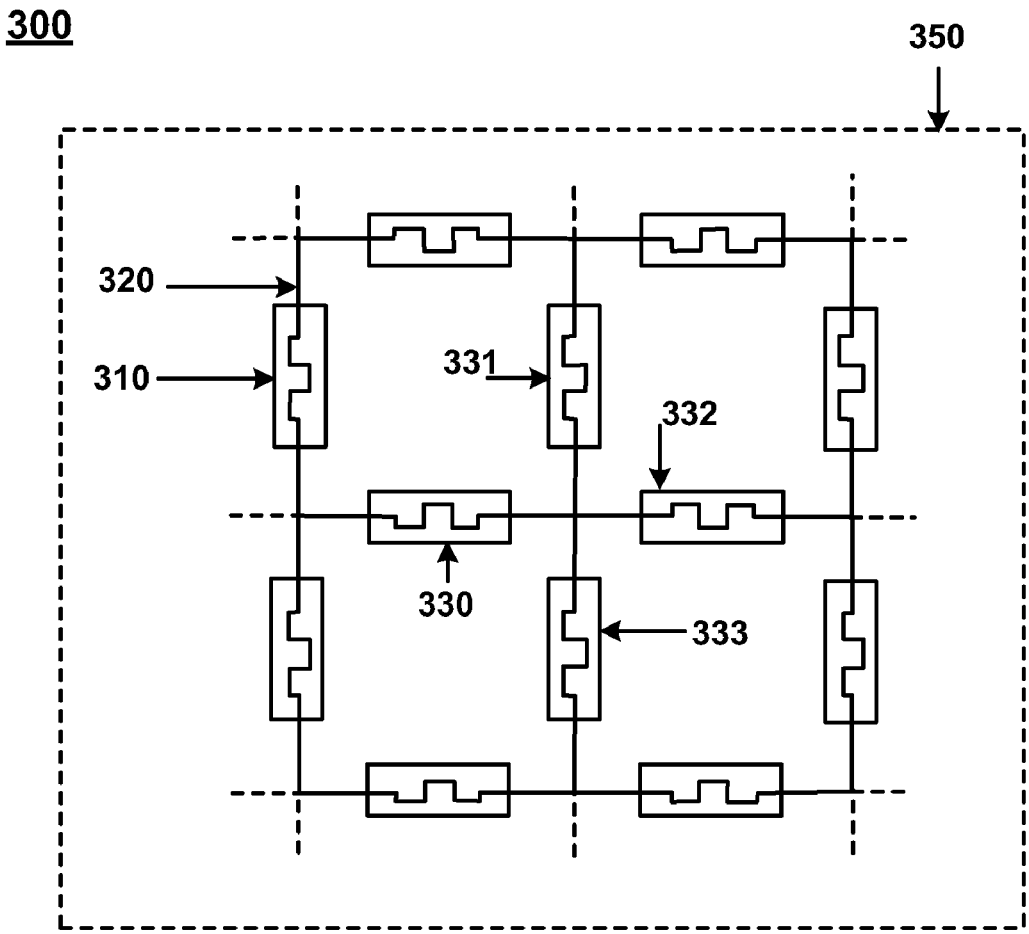
FIG. 3 illustrates an example of an array of memristive antennas, in accordance with an embodiment of the present invention.

An embodiment in accordance with the present invention provides an array of devices 300 for responding to a transmitted energy frequency, as illustrated in FIG. 3. The array of devices includes a memristor 310 and wire 320 that are located outside the group of memristors 330, 331, 332 and 333. It should be appreciated that all of the memristors are coupled with one another. In one embodiment, the array of devices 300 provides for an arbitrary loop size that allows for a programmable resonance frequency. It should be appreciated that a mesh of memristors can be programmed into an arbitrary topology of loops or other circuits of various areas and perimeters. Such a mesh could incorporate fixed resistors or capacitors to allow programming of loops with arbitrary inductance, resistance and capacitance. It should be appreciated that the array of devices includes a material 350 that the circuit(s) is coupled to. The material can be any material that is compatible to being coupled to the circuit(s).

It should also be appreciated an arbitrary circuit topology incorporates inductance, capacitance and a memristor such that the circuit(s) have a resonant frequency. It should be appreciated that an applied time-varying magnetic flux will induce a voltage across a memristor and a resonant antenna is connected to a memristor.

The array of devices 300 is programmable by controlling at least one memristance of a memristor by an applied frequency, such as an applied RF field. For example, by increasing the memristance of memristors 330-333 to a certain memristance, the current through the array of devices 300 can flow around (not through) memristors 330-333, which in turn increases the loop size of the array of devices to at least a size around memristors 330-333. The change in size of the wire loop changes the resonant frequency. The changing of the size of the wire loop of the array of devices allows for the programming of the resonance frequency of the array of devices 300.

In one embodiment the array of devices 300 is externally programmable. For example, the device is externally programmable by using an electromagnetic field to change at least one memristance of the memristors. In other words, an electromagnetic field generates a switching voltage.

In another embodiment, the array of devices is internally programmable. For example, an electrical interface maybe applied to at least one memristor via leads near the memristor. The electrical interface causes the changing of the memristance of the memristor. In another embodiment, the array of devices 300 is erasable. If at least one memristor in the array of memristors is programmable by an applied electromagnetic field, such as but not limited to an applied RF field, then the array of devices 300 can also be erased by an applied electromagnetic field, such as but not limited to an applied RF field. Likewise, the plurality of devices is also externally erasable by an electrical interface.

It should be appreciated that the array of devices 300 can have a plurality of different configurations. It should be appreciated that the loop size can be any arbitrary size. It should be appreciated that the array of devices 300 can include other electrical components such as but not limited to diodes, inductors and capacitors.

The device 100 and/or the array of devices 200 or 300 can be applied to a plurality of different technologies. For example, the device 100 and/or the array of devices 200 or 300 can be applied to the field of RFID. Generally, a RFID system includes a RFID tag that is energized by a time-varying electromagnetic radio frequency wave that is transmitted by a reader. When the RF field passes through an antenna coil, there is an AC voltage generated across the coil. The voltage is rectified to supply power to the RFID tag. The information stored in the RFID tag is transmitted back to the reader, which is often called backscattering. By detecting the backscattering signal, the information stored in the tag is successfully identified. RFID tags typically include basic modulation circuitry and non-volatile memory and RFID tags typically fall into two main categories: passive and active. A passive RFID tag is typically not reprogrammable and an active RFID tag requires a battery to generate and transmit a frequency.

Applying the memristive device 100 or a plurality of devices to an RFID tag allows for the RFID tag to be a programmable passive RFID tag that is much more simplistic than other typical passive RFID tags. In one embodiment, a memristive passive programmable RFID tag includes a wire loop or antenna and a memristor. The memristive passive programmable RFID may also be erasable, as described above. The memristor can be used as nonvolatile memory for the RFID tag. For example, the memristance of the memristor in the RFID tag can be changed or programmed at least the same ways as described above for device 100 and an array of devices 200 or 300.

The device 100 or plurality of devices can be applied to detect if a power threshold has been crossed. As stated above, there is a linear relationship between current and voltage in a typical resistor. However, for some types of memristors there may be a highly nonlinear relationship between current and voltage. When the voltage induced by an oscillating electromagnetic field exceeds some threshold, the current through the memristor may increase suddenly, causing it to change to its conductive state. This property of the memristor allows for a passive electromagnetic threshold detector. It should be appreciated that a threshold detector could be an array of devices that is multi-channeled, as described above.

The device 100 or plurality of devices can be applied to metamaterials. A metamaterial is a material which gains its properties from its structure rather than directly from its composition. A metamaterial affects electromagnetic waves by having structural features smaller than the wavelength of the electromagnetic radiation it interacts with.

A device 100 and/or an array of devices 200 or 300 can be coupled to a metamaterial. The resonant loop in the device or the resonant loops within metamaterial can change the propagation of electromagnetic fields. In other words, the structure of the metamaterial can be changed or reprogrammed due to the device 100 or array of devices 200 or 300 coupled to the metamaterial. For example, an array of devices, such as array of devices 300, can become a loop with programmable topology, as described above. As the resonant frequency is changeable or programmable, the structure of the metamaterial is also changeable or programmable in response to the resonant frequency of the loop of the array of devices 300. It should be appreciated that a single device 100 or an array of devices, such as array of devices 200, can be coupled to a metamaterial in order to control the structure of the metamaterial. It should be appreciated that the metamaterial is programmable by internally and/or externally programming the memristor(s), as described above. It should be appreciated that the metamaterial can be material 170, 250 and/or 350.

Figure 4:
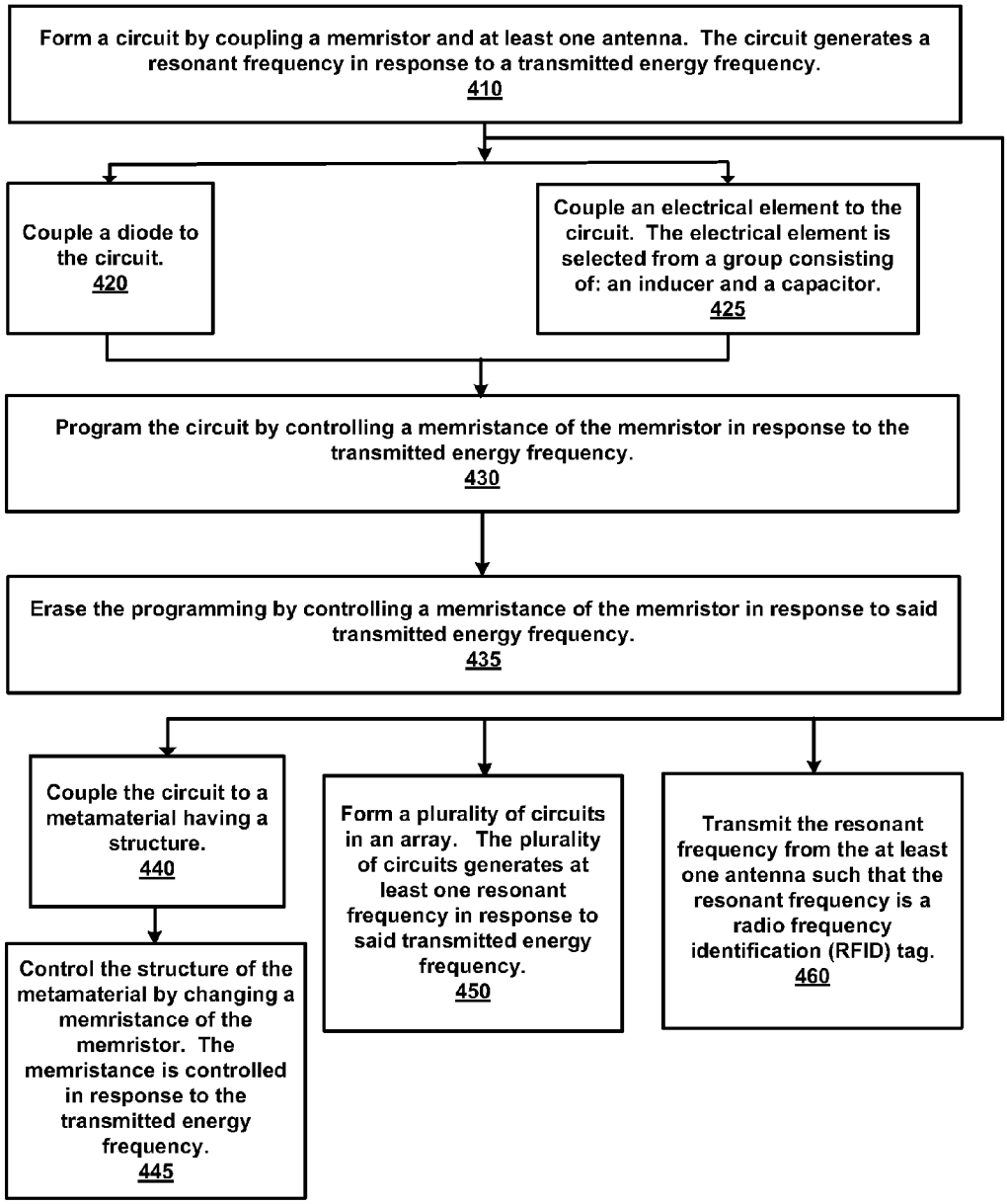
FIG. 4 illustrates an example of a flow chart of a method for responding to a transmitted frequency, in accordance with an embodiment of the present invention.

An embodiment in accordance with the present invention provides a method for responding to a transmitted energy frequency, as illustrated in FIG. 4. At block 410, a circuit is formed by coupling at least a memristor and a wire loop. The circuit generates a resonant frequency in response to a transmitted energy frequency. It should be appreciated the transmitted frequency can be but is not limited to radio, microwave, infrared and optical frequencies.

At block 420, a diode is coupled to the circuit. In another embodiment, at block 425, an electrical element is coupled to the circuit. The electrical element is selected from a group consisting of: an inductor and a capacitor. It should be appreciated that any combination of a diode, inductor and/or capacitor can be coupled to the circuit.

At block 430, the circuit is programmed by controlling a memristance of the memristor in response to the transmitted energy frequency. At block 435, the programmed device is erased by controlling a memristance of the memristor in response to the transmitted energy frequency.

At block 440, the circuit is coupled to a metamaterial having a structure. At block 445, the structure of the metamaterial is controlled by changing a memristance of the memristor. The memristance is controlled in response to the transmitted energy frequency.

At block 450, a plurality of circuits are formed in an array. The plurality of circuits generates at least one resonant frequency in response to the transmitted energy frequency. At block 460, the resonant frequency is transmitted from the wire loop such that the resonant frequency is a radio frequency identification (RFID).

Various embodiments of the present invention are thus described. While the present invention has been described in particular embodiments, it should be appreciated that the present invention should not be construed as limited by such embodiments, but rather construed according to the following claims.

The invention claimed is:

1. An energy responsive device comprising:

a memristor; and at least one antenna, wherein said memristor is coupled to said at least one antenna, and wherein said device is programmable by controlling a memristance of said memristor in response to a transmitted energy frequency.

2. The device of claim 1, further comprising:

an electrical element selected from a group consisting of: an inductor and a capacitor.

3. The device of claim 1, further comprising:

a diode.

4. The device of claim 1, wherein said transmitted energy frequency is selected from a group consisting of: radio, microwave, infrared and optical.

5. The device of claim 1, wherein said programmable device is erasable by controlling said memristance of said memristor in response to said transmitted energy frequency.

6. The device of claim 1, further comprising:

a metamaterial having a structure, wherein said metamaterial structure is controlled by said memristance of said memristor, wherein said memristance is controlled in response to said transmitted energy frequency.

7. The device of claim 1, wherein said device is a plurality of said devices, wherein said plurality of said devices is sensitive to at least one resonant frequency of electromagnetic energy.

8. The device of claim 7, wherein said plurality of said devices are electrically coupled to one another.

9. The device of claim 7, wherein at least one memristance in said plurality of memristors of said plurality of devices is controlled in response to said transmitted energy frequency such that said plurality of said devices forms a particular circuit loop size having a particular resonant frequency.

10. The device of claim 1, wherein said device is a radio frequency identification (RFID) tag.

11. The device of claim 1, wherein said device is an electromagnetic threshold detector.

12. The device of claim 1, wherein said at least one antenna comprises a wire loop.

13. The device in claim 1, wherein said device generates a backscattered electromagnetic field in response to a transmitted electromagnetic field.

14. A method for responding to a transmitted energy frequency, comprising:

forming a circuit by coupling a memristor and at least one antenna, wherein said circuit generates a resonant frequency in response to a transmitted energy frequency and programming said circuit by controlling a memristance of said memristor in response to said transmitted energy frequency.

15. The method of claim 14, wherein said forming a circuit comprises:

coupling a diode to said circuit.

16. The method of claim 14, further comprising:

erasing said programming by controlling said memristance of said memristor in response to said transmitted energy frequency.

17. The method of claim 14, further comprising:

coupling said circuit to a metamaterial having a structure; and controlling said structure of said metamaterial by changing said memristance of said memristor, wherein said memristance is controlled in response to said transmitted energy frequency.

18. The method of claim 14, further comprising:

transmitting said resonant frequency from said at least one antenna such that said resonant frequency is a radio frequency identification (RFID) tag.

* * * * *

UNITED STATES PATENT AND TRADEMARK OFFICE

CERTIFICATE OF CORRECTION

PATENT NO. : 8,081,129 B1
APPLICATION NO. : 12/415715
DATED : December 20, 2011
INVENTOR(S) : Charles M. Santori et al.

It is certified that error appears in the above-identified patent and that said Letters Patent is hereby corrected as shown below:

In column 8, line 37, in Claim 4, delete "optical." and insert -- optical frequencies. --, therefor.

In column 9, line 3, in Claim 14, delete "frequency" and insert -- frequency; --, therefor.

Signed and Sealed this
Twenty-third Day of October, 2012

David J. Kappos

David J. Kappos
*Director of the United States Patent and Trademark Office*